US005406887A

United States Patent [19]

Hertel et al.

[11] Patent Number: 5,406,887

[45] Date of Patent: Apr. 18, 1995

[54] APPARATUS AND METHOD FOR DOCTOR BLADE REPLACEMENT IN A FLEXOGRAPHIC PRESS

[75] Inventors: James E. Hertel, Green Bay; Dale E. Zeman, Denmark; Dennis W. Ehlers, De Pere, all of Wis.

[73] Assignee: Paper Converting Machine Company, Green Bay, Wis.

[21] Appl. No.: 147,849

[22] Filed: Nov. 3, 1993

Related U.S. Application Data

[63] Continuation-in-part of Ser. No. 4,948, Jan. 15, 1993, abandoned.

[51] Int. Cl.[6] ..... B41F 31/04

[52] U.S. Cl. ..... 101/366; 101/350; 101/351

[58] Field of Search ..... 101/350, 351, 352, 363, 101/364, 365, 366, 207, 208, 209, 210, 157, 169; 118/261, 410

[56] References Cited

U.S. PATENT DOCUMENTS

| | | | |
|---|---|---|---|
| 4,066,014 | 1/1978 | van Haaften | 101/157 |
| 5,012,736 | 5/1991 | Van Kanegan et al. | 101/211 |
| 5,031,529 | 7/1991 | Greenwood | 101/142 |
| 5,125,341 | 6/1992 | Yaeso | 101/367 |
| 5,150,651 | 9/1992 | Flores | 101/366 |
| 5,184,556 | 2/1993 | Schaeuble | 101/483 |

*Primary Examiner*—Edgar S. Burr
*Assistant Examiner*—Stephen R. Funk
*Attorney, Agent, or Firm*—Tilton, Fallon, Lungmus & Chestnut

[57] ABSTRACT

Apparatus and method for flexographic printing wherein a press having a frame is equipped with an ink transfer roll, a subframe is movably mounted on the frame adjacent the transfer roll, a holder being movably mounted on the subframe, the holder being equipped with upper and lower doctor blades engaging the transfer roll and end seals defining with the roll a liquid chamber, and an ink inlet and an ink outlet in the holder, the subframe having portions clamping the doctor blades to the holder, the subframe being pivotally mounted on the frame for movement away from the ink transfer roll, the subframe being equipped with a cylinder for moving the holder so as to unclamp the doctor blades for replacement.

14 Claims, 4 Drawing Sheets

APPARATUS AND METHOD FOR DOCTOR BLADE REPLACEMENT IN A FLEXOGRAPHIC PRESS

This application is a continuation-in-part of application Ser. No. 4,948, filed Jan. 15, 1993, now abandoned.

BACKGROUND AND SUMMARY OF INVENTION

This invention relates to an apparatus and method for doctor blade replacement in a flexographic press and, more particularly, to a fountain embodying a movable holder for the blades.

Conventionally, doctor blades are provided to define the upper and lower ends of a fountain associated with an ink transfer roll—such as an anilox roll. Illustrative of the basic structure is that shown in co-owned U.S. Pat. No. 5,125,341. When it is desired to replace the doctor blades, a labor-intensive situation arises. Bolts have to be loosened and then retightened in order to clamp the doctor blades and if the operation is not carefully handled, a wave will be introduced into the blade. This is avoided by the instant invention which provides a doctor blade holder which is movably mounted on a sub-frame of the press. The sub-frame of the press is part of the basic fountain structure and is located immediately adjacent the anilox roll. The sub-frame has portions for clamping the doctor blade in place on the holder and bearing against the anilox roll. The invention makes it possible to equip the movable holder with the blades at either the press or at a location remote from the press—but in any event, quickly install the blades thereby avoiding the laborious operations of the past.

Other objects and advantages of the invention may be seen in the details of the ensuing specification.

BRIEF DESCRIPTION OF DRAWING

The invention is described in conjunction with illustrative embodiments in the accompanying drawing, in which.

DETAILED DESCRIPTION

Figure 3:
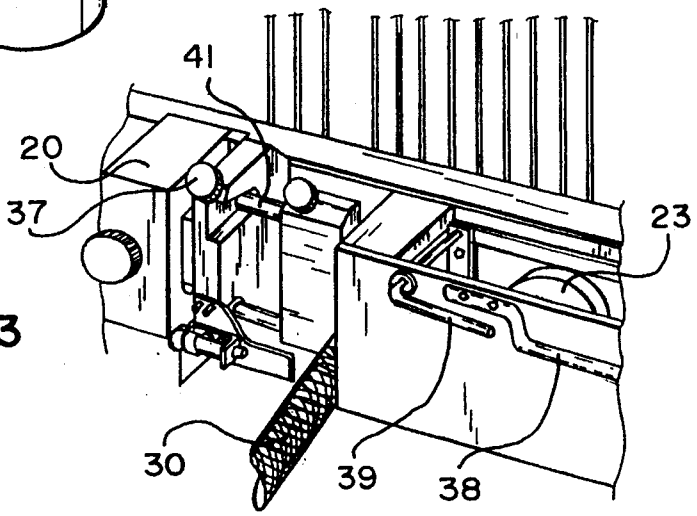
FIG. 3 is a fragmentary perspective view of the apparatus of FIG. 2.
Figure 1:
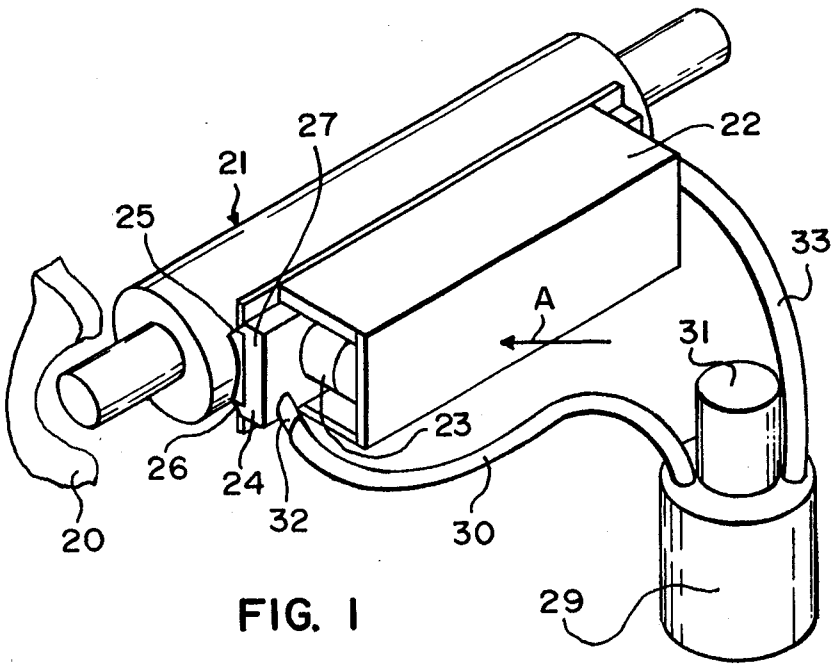
FIG. 1 is a perspective view, somewhat simplified, of a portion of a flexographic press.
Figure 6:
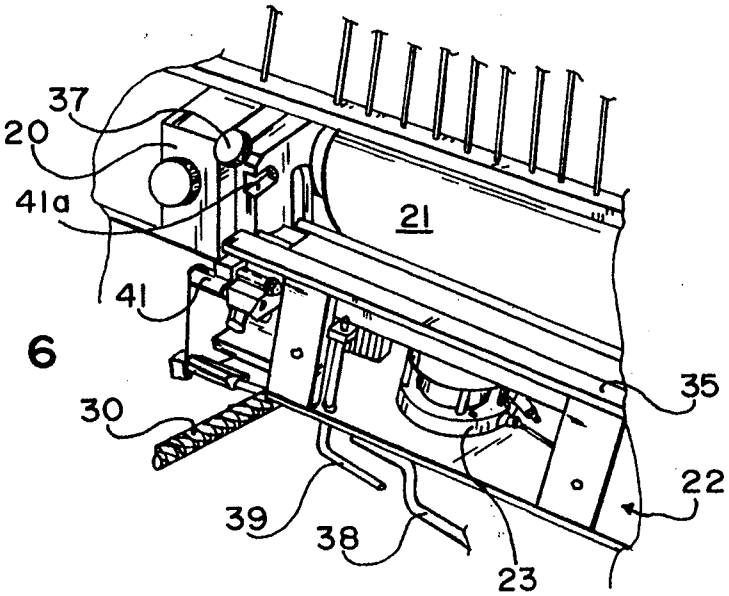
FIG. 6 is a fragmentary perspective view of the apparatus of FIG. 4.

In the illustration given and with reference first to FIG. 1, the numeral 20 designates generally a fragment of the frame of the flexographic press. A similar fragment is seen in FIGS. 3 and 6. Other details of the frame are omitted for ease of presentation but additional details can be seen in co-owned U.S. Pat. No. 5,012,736.

The frame 20 rotatably supports an anilox roll generally designated 21 which can be considered an ink transfer roll of the type described in greater detail in the above-mentioned U.S. Pat. No. 5,012,736. Movably mounted on the frame for coaction with the anilox roll 21 is a subframe generally designated 22 and which is seen to be essentially C-shaped in side elevation. Still referring to FIG. 1, it is seen that the subframe 22 carries fluid pressure cylinder means 23. These cylinder means in turn carry the blade-mounting holder 24. The holder 24 is equipped with an upper doctor blade 25 and lower doctor blade 26. These blades, along with end seals 27 (only one seen at the left of FIG. 1), holder 24 and anilox roll 21 define an ink chamber 28 (see FIG. 2).

In normal operation, ink is contained in ink pail 29 and is delivered through supply line 30 by motorized pump 31. The ink enters a lower port 32 in the holder 24 and the excess exits from an upper port (not shown) through the return line 33 to the pail 29.

Figure 2:
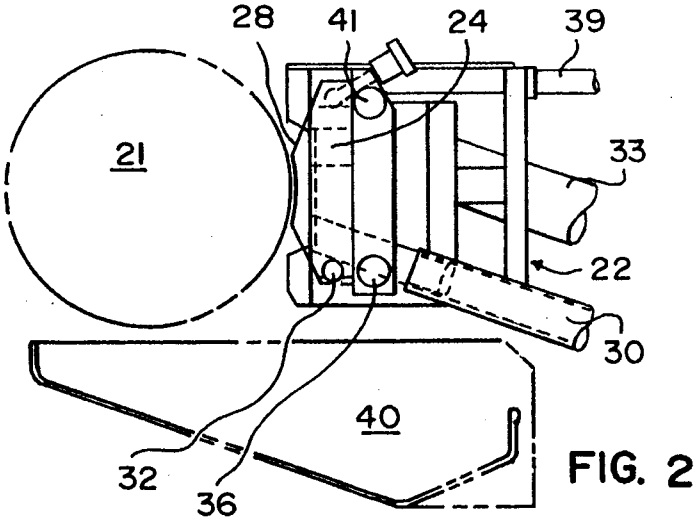
FIG. 2 is a side elevational view of certain of the elements of FIG. 1 as they would be disposed during "inking" of the anilox roll.

FIG. 2 shows the orientation of the just-described elements during "inking" i.e., printing. At that time, the doctor blades 25, 26 are firmly clamped to the holder by the subframe 22. More particularly, the ends of the subframe adjacent the anilox roll 21 are equipped with a top clamp bracket 34 and a bottom clamp bracket 35—see the right and central portions of FIG. 5. These brackets extend the length of the blades—see for example, the bracket 35 in FIG. 6. A plurality of cylinders 23 are provided along the bracket length for uniform clamping pressure.

Figure 5:
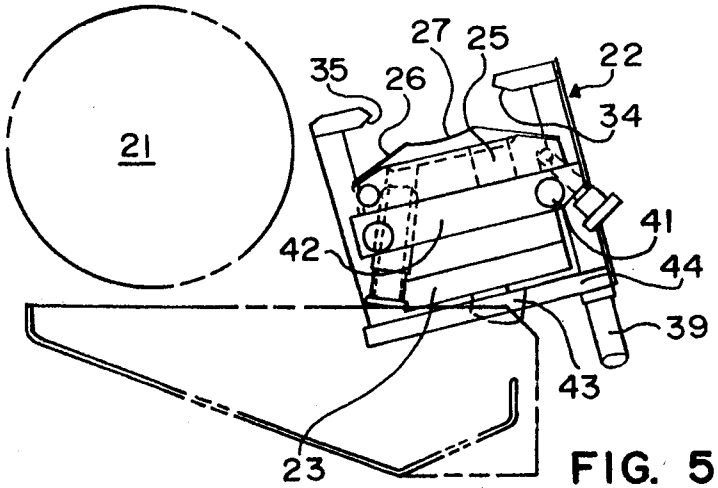
FIG. 5 is a view similar to FIG. 4 but with the doctor blades unclamped for ease of replacement.
Figure 4:
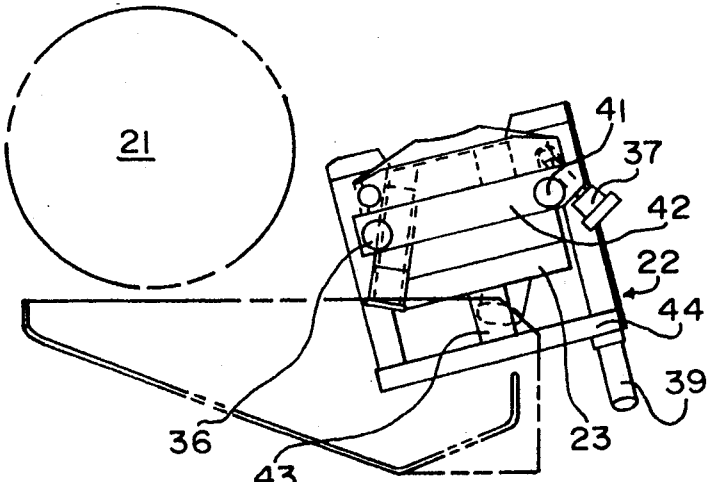
FIG. 4 is a view similar to FIG. 2 but with the subframe pivoted away from the anilox roll preparatory to doctor blade replacement.

For blade replacement, the subframe 22 is pivotally mounted on the press frame as at 36 and the pivoted "away" position is seen in FIGS. 4–6. Then the holder is withdrawn from the brackets 34, 35 by the cylinder means 23—see FIG. 4.

The pivot axis 36 is located on the frame 20 so that both the edge of the lower doctor blade 26 and the part of the bracket 35 closest to the anilox roll 21 will clear the roll and without the need for translating the subframe 22.

DOCTOR BLADE CHANGEOVER

This sequence is started with the doctor chamber inked up at the end of a run, and the following steps performed:

1. Remove ink from doctor chamber by draining through supply side hole line 30.
2. Pivot the doctor blade subframe 22 to FIG. 4 position to expose chamber. This is accomplished by backing off the upper thumb screws 37 and manually pivoting the subframe against a stop provided by the frame at 38 (see FIG. 6). There, the pivot handle is designated 39 and is seen abutting the part 38 of the frame.
3. Unclamp the doctor blades by retracting air cylinder means 23—compare FIGS. 4 and 5.
4. Remove the used blades.
5. Wipe the remaining ink off of the anilox roll 21 and doctoring system, i.e., the holder 24, and seals 27, etc.

6. Replace the end seals 27 if needed.
7. Place new steel blades against magnets in the doctor blade holder. The magnets can be best seen in FIG. 10. In lieu of ferrous material blades—as where plastic blades are used—a seating recess or shoulder can be provided.
8. Clamp the blades in place with air cylinder 23.
9. Pivot doctor blade chamber back to run position and lock in place with the thumb screws 37.
10. The chamber 28 is then filled with ink and the drive for the anilox roll is started. Any excess ink on the roll is caught in the ink pan 40—see FIG. 2.

The features/benefits of the invention are:

1. Time Saving—the system pneumatically clamps and unclamps blades without the use of any tools and fasteners—with approximately ten minutes saved per blade change.
2. Operator friendly—the blade holder 24 stays in the press requiring only the handling of the blades and the end seals.
3. Safer system—Spent blades can be removed prior to chamber washup.
4. Compatibility—Interchanges with previous doctor blade holders with minimal changes.
5. Ease of Cleanup—Shallow chamber 28 with drain system greatly reduces amount of ink in the chamber prior to cleanup.

STRUCTURAL DETAILS

These are now described first with reference to FIGS. 3 and 6. Each of these fragmentary perspective views is generally in the direction of the arrow A as applied to FIG. 1. So, in FIG. 3, the hose 30 is readily seen. So also is the handle 39 and cylinder means 23.

In FIG. 6, the same three elements are designated, viz., 23, 30 and 39. Also seen clearly in FIG. 6 is the locking pin 41. This is the pin held in place by thumb screw 37—compare FIGS. 2 and 4.

Referring again to FIG. 6, there is seen a slot 41*a* provided in the frame 20 which receives the pin 41 when the fountain is in the inking or printing mode. The pins 41 (one at each end) are carried by an adapter bar 42—see FIGS. 4 and 5. The bar 42 is slidably mounted on the subframe 22 and carries the holder 24 and the cylinder means 23. The piston rod 43 of the cylinder means 23 is attached to the bight portion 44 of the subframe 22—still comparing the right portions of FIGS. 4 and 5.

EMBODIMENT OF FIGS. 7–9

Figure 8:
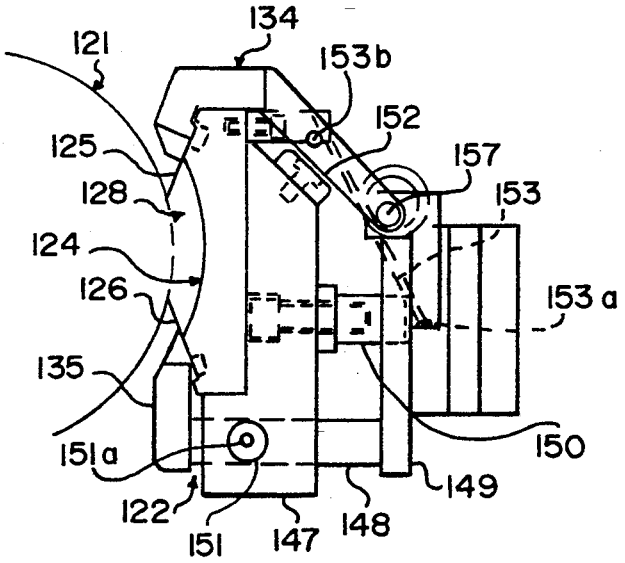
FIG. 8 is a sectional view taken along the sight line 8—8 applied to FIG. 7.
Figure 9:
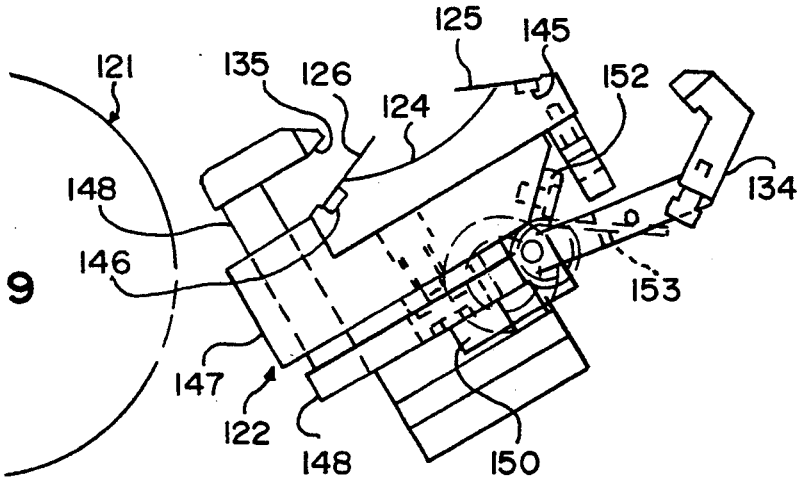
FIG. 9 is a view similar to FIG. 8 but showing the parts in a different operating condition.

Here like numerals are applied to similar elements but with the addition of 100. In FIGS. 8 and 9 the numerals 121 designates an anilox roll. A holder 124 is provided which has doctor blades 125 and 126 held on by magnets 145, 146 (see FIG. 9). The essential difference of this embodiment from that of FIGS. 1–6 is in the provision of a different subframe generally designated 122. However, as before, the subframe 122 and the holder 124 make up the fountain and the subframe 122 is again generally C-shaped.

Physically supporting the holder 124 is an L-shaped bracket 147. The bracket 147 is slidably supported on rods 148 which constitute the lower legs of the C-shaped subframe 122 (see also FIG. 7). The rods 148 are rigidly fixed in the subframe 122 and, more particularly to the bight portion 149 of the generally C-shaped subframe 122. Pivotally mounted on the upper end of bight portion 149 is clamp member 134—see the extreme right of FIG. 9. Completing the C-shape is the bottom clamp member 135 mounted on rods 148. Like their counterparts in the embodiment of FIGS. 1–6, the members 134 and 135 clamp the doctor blades 127, 126 against the holder 124 so as to define chamber 128 (see FIG. 7).

Figure 7:
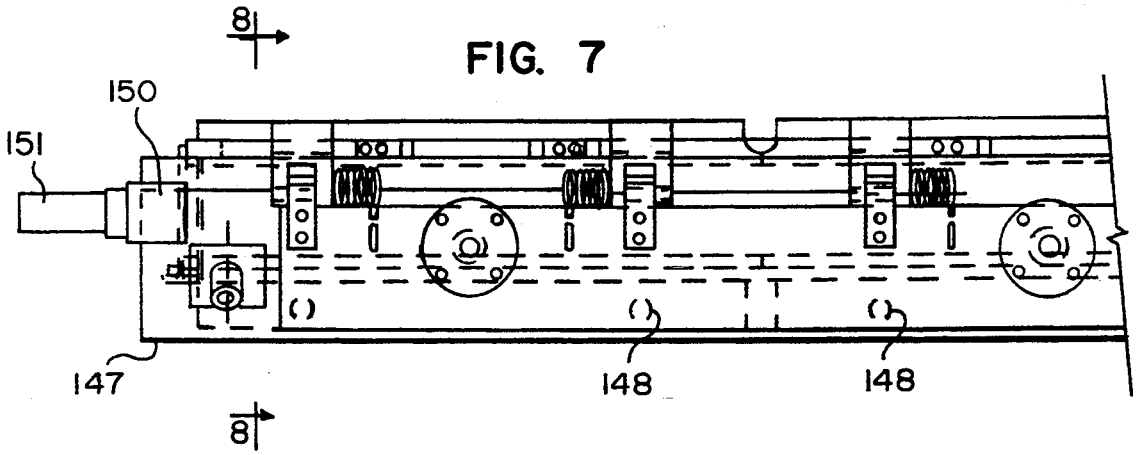
FIG. 7 is a fragmentary side elevational view of a modified version of the invention featuring a removable holder.

As can be seen in FIG. 7 at the left hand end, the bracket 147 is equipped with an end bore 150 which provides journal 151. A similar arrangement is provided at the right hand end (not shown) so as to rotatably support the overall fountain assembly on the machine frame (not shown).

Once the holder 124 is desired to be replaced, the subframe 122 is retracted away from the anilox roll 121. This can be appreciated from a consideration of FIG. 9. This differs from the showing in FIG. 8 where the fountain is in operational position with the doctor blades 125, 126 bearing against the anilox roll 121.

To proceed from the disposition of elements in FIG. 8 to that of FIG. 9, we both retract and rotate the holder 124. Rotation occurs about the axis 151*a* of the journals 151—see the lower center of FIG. 8. For this purpose, we connect the ends of the L-shaped bracket 147 to a suitable retraction/rotation means such as a stepping motor driving a screw actuator as seen in co-owned U.S. Pat. No. 5,184,556. Alternatively, the retraction/rotation means may be in the nature of a pressure fluid cylinder, ball and screw arrangement, etc. so as to retract the ends of L-shaped bracket 147 and also rotate the same to the condition depicted in FIG. 9.

Either simultaneously with the foregoing movement or shortly thereafter, the pancake cylinder 123 is energized to unclamp the holder 124. For that purpose, the cylinder 123 is rigidly mounted on the bight portion 149. The piston rod 143 of the cylinder 123 extends through the portion 149 and is coupled to the L-shaped bracket 147. As the piston rod is retracted into the air cylinder, the bight portion 149 moves toward the L-shaped bracket 147. This unclamps the lower blade 126 from the angled surface of the member 135 (see the upper left center of FIG. 9).

For unclamping the blade 125 from the clamping surface on the member 134, the member 134 is pivoted by the withdrawing action of the piston rod of the cylinder 123. More particularly, the member 134 is pivotally mounted as at 157 at the upper end of the bight portion 149. As the piston rod 143 is retracted (going from the FIG. 8 showing to that of FIG. 9), the bight portion 149 moves to the left and the member 134 bears against and pivots on a mushroom-shaped button 152. This unclamps the upper blade 125. The member 134 is urged back into clamping position by the torsion spring 153—so that when fluid pressure is removed from the cylinder 123, the spring 153 moves the member 134 back to its FIG. 8 position. This occurs by virtue of the torsion spring 153 being fixed at its lower end as at 153*a* and bears against a post 153*b* on member 134 at its upper end.

EMBODIMENT OF FIGS. 10–11

Again, the frame 220 supports an anilox roll generally designated 221. Movably mounted on the frame for coaction with the anilox roll 221 is a subframe generally designated 222 and which is seen to include two portions or members 254 and 255. These members are pivotally interconnected at 256 and the member 255 can be pivoted to the position 255' shown in dotted line. This is advantageously achieved through a pressure fluid cylinder 223 which is mounted on a clevis fixed to the member 254. The piston rod 257 of the pressure fluid cylinder is seen to be equipped at its work end with an arm 258 rigidly connected to the upper member 255. Retraction of the rod 257 pivots the upper member 255 to the 255' position and effectively unclamps the holder 224.

It will be noted that each of the members 254, 255 is generally L-shaped so as to provide parts for clamping the upper doctor blade 225 against an angled clamp surface 258 provided as part of an arm 259 which in turn is provided as part of the holder generally designated 224. Thus, the holder 224 and subframe 222 make up a fountain F.

Figure 11:
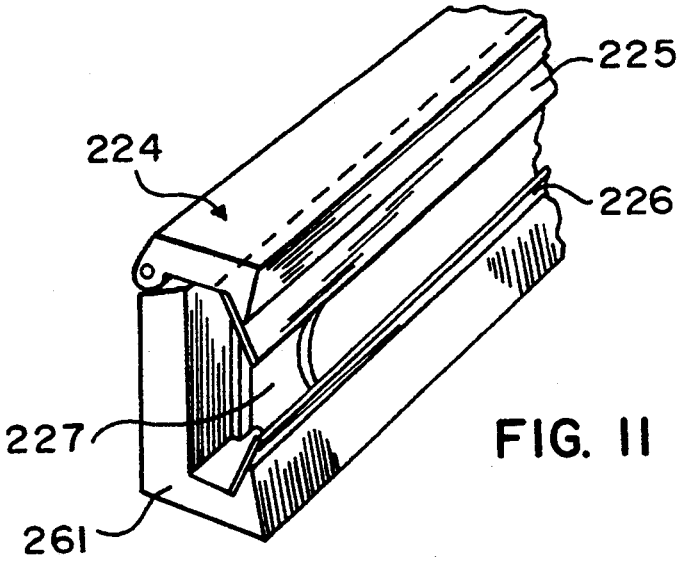
FIG. 11 is a fragmentary perspective view of the cartridge portion of FIG. 10.

In similar fashion, the lower member 254 clamps the lower doctor blade 226 against the surface 260 provided on the holder 224. More particularly, the holder 224 is C or channel shaped having the arms 259, 261 connected by a bight portion 262. Completing the closing of the fountain are end seals as at 227 in FIG. 11.

OPERATION

Figure 10:
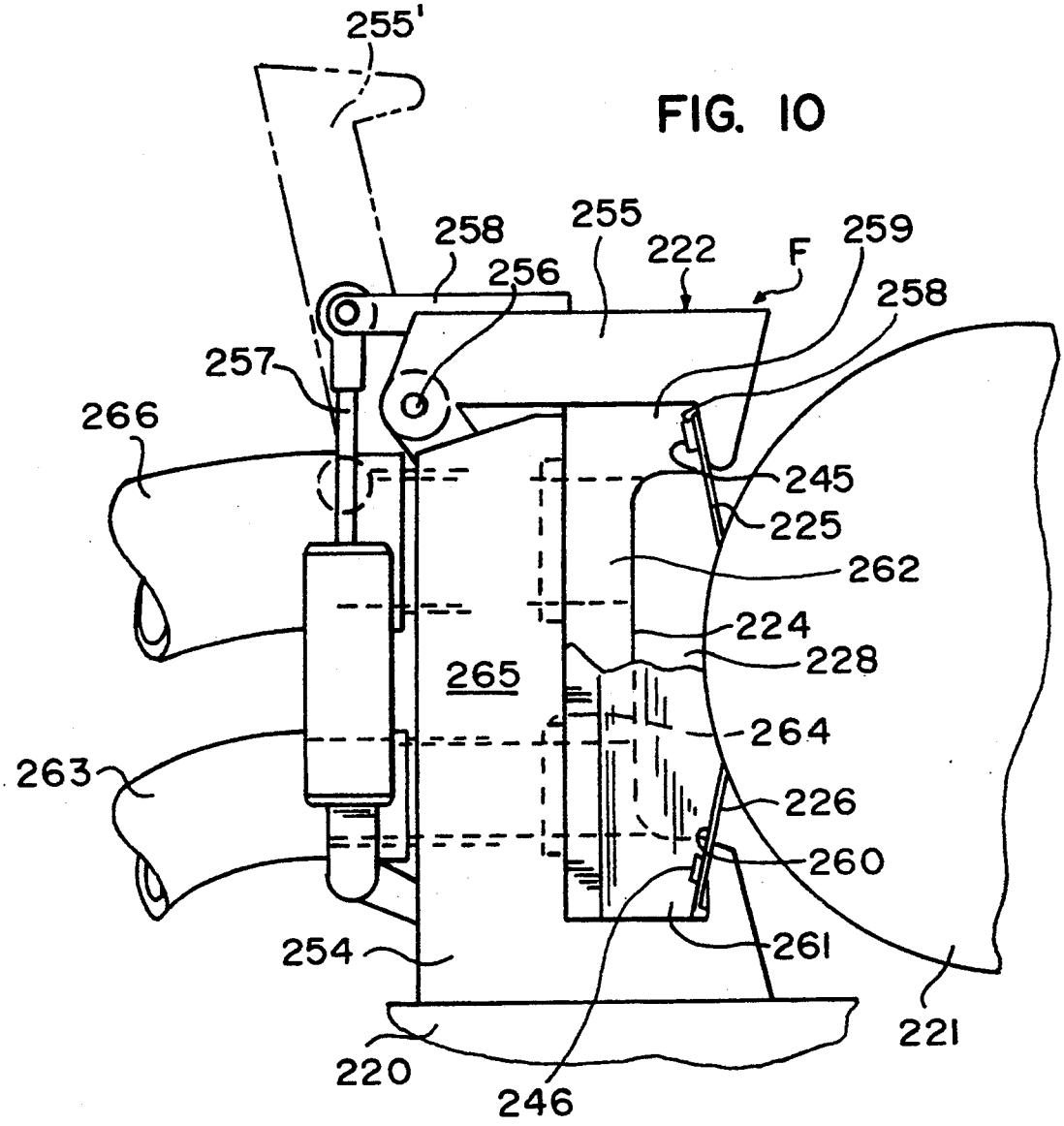
FIG. 10 is a side elevational view, partially schematic, of a flexographic press equipped with another modified cartridge of the invention.

When the holder 224 is installed as seen in FIG. 10, liquid to be taken up by the transfer roll 221 is introduced via the conduit 263 into an inlet port in the member 254 and through an aligned port in the holder 224. The member is recessed so as to accommodate the installation of an O-ring 264.

In similar fashion, another O-ring is disposed about the outlet passage 265 in the member 254 which is aligned with the conduit 266. This results in a liquid level in the ink chamber 228. The excess liquid, i.e., ink is returned for recirculation.

With ink in the fountain F, the cavities in the anilox roll can be filled under the control of the upper doctor blade 225—assuming the rotation of the anilox roll to be clockwise. With reverse rotation, the doctoring is provided by the blade 226.

When holder replacement is indicated—worn doctor blades, change of liquid, etc., the fountain chamber 228 is drained and the cylinder 223 actuated to pivot the member 255 to the dotted line position 255'. The member 254 is moved relative to the frame 220 to space the fountain F from the anilox roll 221. A suitable mechanism for this can be seen in co-owned U.S. Pat. No. 5,184,556. This permits the holder 224 to be withdrawn from its mounting.

Then, at a site convenient to but generally remote from the flexographic press, the operator can install new doctor blades 225, 226. These are mounted against the bearing surfaces on the holder 224 and because they are normally made of ferrous material may be advantageously held in place temporarily by use of magnets 245, 246.

While in the foregoing specification a detailed description of an embodiment of the invention has been set down for the purpose of illustration, many variations in the details hereingiven may be made by those skilled in the art without departing from the spirit and scope of the invention.

We claim:

1. A flexographic press having a frame equipped with an ink transfer roll, a subframe mounted on said frame adjacent said roll, a holder movably mounted on said subframe, said holder being equipped with upper and lower doctor blades engaging said roll and end seals defining with said roll a liquid chamber, and ink inlet and outlet means in said holder, said subframe having portions clamping said doctor blades to said holder.

2. The press of claim 1 in which said holder has upper and lower blade supporting surfaces, means associated with each surface for temporarily uniting said blade and surface.

3. The press of claim 2 in which said uniting means includes magnetic means, said doctor blades being constructed of ferrous material.

4. The press of claim 1 in which said subframe is generally C-shaped and equipped with a fluid pressure cylinder means operatively coupled to said holder to unclamp said blades.

5. The press of claim 5 in which pivot means interconnect said subframe with said frame.

6. The press of claim 1 in which said subframe includes a pair of pivotally interconnected members.

7. The press of claim 6 in which one of said subframe members is equipped with rod means, and an L-shaped bracket slidably mounted on said rod means.

8. The press of claim 7 in which an air cylinder is mounted on said one subframe member and having a piston rod connected to said bracket.

9. A flexographic press comprising a frame, an anilox roll rotatably mounted in said frame, a subframe pivotally mounted on said frame adjacent said anilox roll, a doctor blade holder reciprocally mounted on said subframe for movement toward and away from said anilox roll, upper and lower doctor blades removably mounted on said holder and in one position of said subframe being against said anilox roll, said subframe having a pair of spaced apart clamping surfaces, one for each of said upper and lower doctor blades, and reciprocating means operatively coupled between said subframe and said holder for moving said doctor blades out of clamping relation with said clamping surfaces.

10. The press of claim 9 in which an adapter bar is reciprocally mounted on said subframe, said holder being mounted on said adapter bar and lock means on said adapter bar, said reciprocating means including fluid pressure cylinder means connected between said subframe and adapter bar.

11. The press of claim 10 in which said frame is equipped with a slot, said lock means including a pin removably insertable into said slot.

12. A method for doctor blade replacement in a flexographic press comprising the steps of providing a frame equipped with an ink transfer roll, a subframe movably mounted on said frame adjacent said roll, a holder movably mounted on said subframe, said holder being equipped with upper and lower doctor blades engaging said roll and end seals defining with said roll a liquid chamber, and ink inlet and outlet means in said holder, said subframe having portions clamping said doctor blades to said holder, moving said subframe away from said ink transfer roll and moving said holder relative to said subframe to unclamp said blades.

13. The method of claim 12 in which said steps include providing said clamping portions of a length substantially the length of said doctor blades, and applying clamping pressure at longitudinally spaced areas of said clamping portions to substantially uniformly clamp said blades.

14. The method of claim 12 in which said steps include providing said holder with means for temporarily supporting said blades until said subframe clamping portions are brought into clamping engagement with said blades.

* * * * *